United States Patent [19]

Lithgow

[11] 4,231,538

[45] Nov. 4, 1980

[54] CLAMPING DEVICES

[75] Inventor: Keith B. Lithgow, Bletchley, England

[73] Assignee: Microform Communications Limited, Bletchley, England

[21] Appl. No.: 950,405

[22] Filed: Oct. 11, 1978

[30] Foreign Application Priority Data

Oct. 12, 1977 [GB] United Kingdom ..... 42474/77

[51] Int. Cl.[3] ..... E04G 3/00

[52] U.S. Cl. ..... 248/226.1; 24/248 R

[58] Field of Search ..... 248/226.1, 226.2, 228, 248/316 A, 316 B; 24/248 SA, 248 B, 248 R, 263 A

[56] References Cited

U.S. PATENT DOCUMENTS

| | | | |
|---|---|---|---|
| 556,239 | 3/1896 | Ashald | 248/226.2 X |
| 934,676 | 9/1909 | Langslow | 248/226.2 X |
| 2,691,201 | 10/1954 | Matthews | 24/248 SA |
| 3,358,957 | 12/1967 | Lindenmuta | 248/226.1 X |
| 3,383,101 | 5/1968 | Albert | 24/248 R X |
| 3,747,898 | 7/1973 | Warren | 248/226.1 X |
| 3,756,568 | 9/1973 | Mocny et al. | 248/226.1 X |
| 3,841,609 | 10/1974 | Smith | 248/226.1 X |
| 3,863,900 | 2/1975 | Dagiel | 248/226.1 X |
| 3,881,698 | 5/1975 | Marsh | 248/226.1 X |
| 3,909,889 | 10/1975 | Emerson | 24/248 SA X |

FOREIGN PATENT DOCUMENTS

| | | | |
|---|---|---|---|
| 1068115 | 5/1967 | United Kingdom | 24/248 SA |

*Primary Examiner*—J. Franklin Foss

*Attorney, Agent, or Firm*—Lawrence E. Laubscher

[57] ABSTRACT

A clamping device for clamping to a parallel sided support, e.g. a desk top or shelf comprises an elongate base on which is rigidly mounted a first arm. A second arm is slidable on the base and carries a screw which engages the rear face of the base to define a pivot axis. A second screw is manually rotatable to engage the base and pivot the arm about the pivot axis until the edge of the face plate engages the base to lock the arm in position. By suitable pre-setting of the screw the arm locks when the face plates are parallel. The clamping device may be used to support a microfilm projector.

4 Claims, 3 Drawing Figures

CLAMPING DEVICES

STATEMENT OF THE INVENTION

This invention relates to clamping devices, and more particularly to a clamping device suitable for clamping to a parallel sided support, e.g. a desk top or shelf.

According to one feature of the present invention a clamping device comprises a first clamp member having an elongate base and a first clamp arm extending laterally outwardly from the base, and a second clamp member mounted on the base for sliding movement therealong, the second clamp member comprising: a second clamp arm extending laterally outwardly from the base, facing the first clamp arm; pivot means for engaging the first clamp member to define a pivot axis; force means for engaging the first clamp member at a position spaced from the pivot axis to rotate the second clamp member about the pivot axis to move the second clamp arm towards the first clamp arm; and stop means for engaging the first clamp member to limit rotation of the second clamp member and, in combination with the force means and the pivot means to lock the second clamp member relative to the first clamp member at any desired spacing between the clamp arms.

Preferably, the pivot means is adjustable and is set such that when the second clamp member is locked relative to the first clamp member, the clamp arms are parallel. In this case, before the force means is operated to rotate the second clamp member into its locked position, the clamp arms will diverge slightly away from the base. To clamp the clamping device to a parallel sided support, e.g. a desk top, the first clamp arm is placed against one surface of the support and the second clamp member is slid along the base until the second clamp arm engages the other surface of the support. The force means is then operated to pivot the second clamp arm up into firm engagement with the said other surface, clamping the device to the support. Further operation of the force means causes locking of the second clamp member to the first clamp member, thereby preventing the clamp from working loose.

Preferably the pivot means and the force means are screws threadingly engaged in the second clamp member and bearing on the surface of the base remote from the clamp arms. The stop means preferably comprises the edge of a plate which engages the surface of the base adjacent the clamp arms.

BRIEF DESCRIPTION OF THE PRIOR ART

The above and further features and advantages of the invention will be better understood from the following description of an embodiment thereof, given by way of example only, reference being had to the accompanying drawings, wherein.

DETAILED DESCRIPTION

Figure 1:
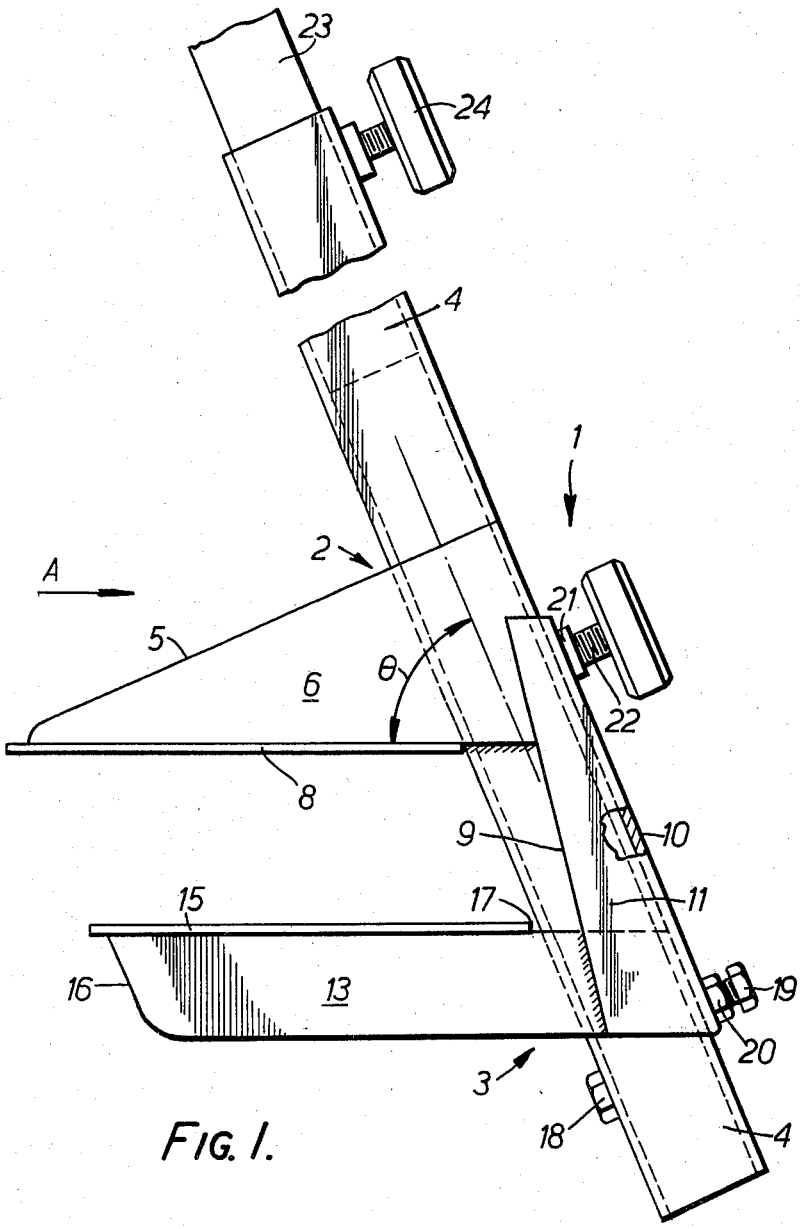
FIG. 1 is a side view of a clamping device.
Figure 2:
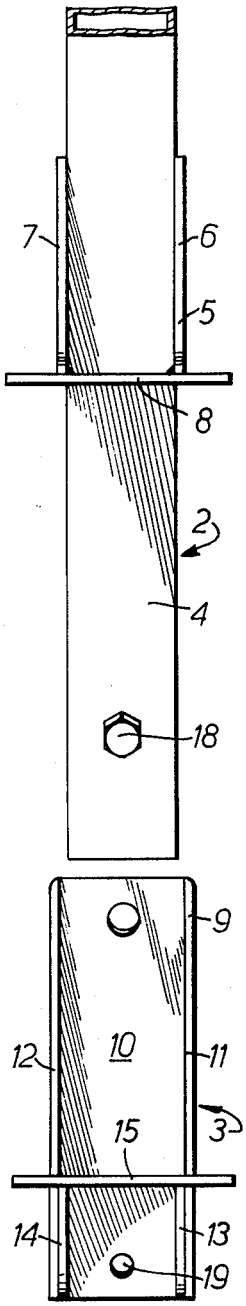
FIG 2 is an exploded view, in the direction of the arrow A of FIG. 1, of the clamping device.
Figure 3:
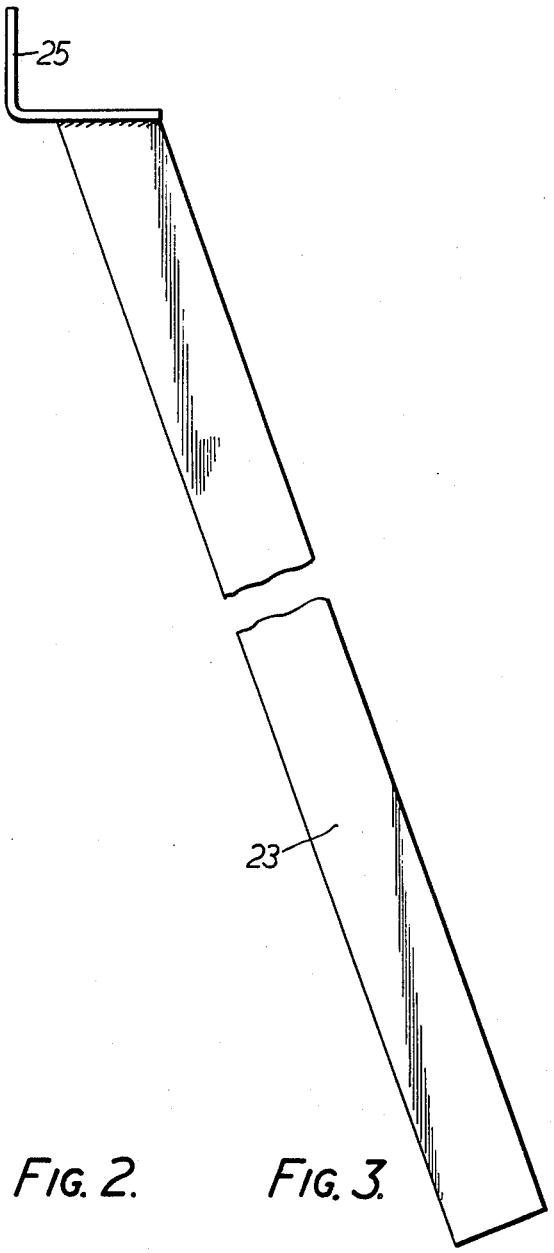
FIG. 3 is a side view of a telescopic arm.

The clamping device 1 shown in the drawings comprises a first clamp member 2 and a second clamp member 3. The first clamp member 2 comprises an elongate base 4 of square cross-section steel tube, and a first clamp arm 5 secured to and extending laterally outwardly from the base 4.

The first clamp arm 5 comprises side plates 6,7 welded to the sides of the base 4, and a face plate 8 welded to the side plates 6,7. The face plate makes an angle $\theta$ of approximately 70° to the longitudinal axis of the base 4 so that, in use, with the face plate 8 resting on the top of a desk or shelf with edge of the desk or shelf touching the base 4, the upper portion of the base extends over the desk or shelf for reasons explained hereinafter. However, it should be appreciated that this is a preferred arrangement only, and that in other embodiments of clamping device intended for other uses, the angle between the face plate 8 and the longitudinal axis of the base may be different from that of the illustrated embodiment.

The second clamp member 3 comprises a back member 9 of generally channel-shaped cross-section having a rear wall 10 and side walls 11,12 extending perpendicularly from the rear wall. Side plates 13,14 are welded to the side walls 11,12 and a face plate 15 is in turn welded to the side plates. The side plates 13,14 and face plate 15 together form a second clamp arm 16 which extends laterally outwardly from the base 4, facing the first clamp arm 5.

The spacing between the edge 17 of the face plate 15 adjacent the base 4, and the rear wall 10 of the back member 9 is such that with the rear wall 10 resting against the adjacent wall of the base 4, the edge 17 is slightly spaced from the base so that the second clamp member 3 is a sliding fit on the base 4. A stop screw 18 is provided to retain the second clamp member 3 on the base.

A screw-threaded hole is formed centrally in the rear wall 10 adjacent its lower end and carries a screw 19 provided with a lock nut 20. The inner end of the screw 19 projects from the rear wall 10 to bear against the adjacent wall of the base 4. The projecting portion forms a pivot for the second clamp arm 3, permitting the second clamp arm to be pivoted to a limited extent about a pivot axis extending through the tip of the screw perpendicular to the plane of side walls 11,12.

Adjacent the upper end of the rear wall 10, a threaded bush 21 is secured to the rear wall. A screw 22 having a large manually graspable head extends through the bush and can be screwed into contact with the adjacent wall of the base to apply a torque to the second clamp member to rotate the second clamp member clockwise as viewed in FIG. 1 about the pivot axis defined by screw 19.

The amount by which the second clamp member can be rotated is limited by the edge 17 of face plate 15. As the screw 22 is rotated to pivot the second clamp arm in the clockwise direction, the edge 17 aproaches and eventually abuts the adjacent surface of the base 4. This prevents further rotation of the second clamp arm. Continued rotation of the screw 22 forces the edge 17 and the tips of screws 19 and 21 firmly against opposite sides of the base 4, locking the second clamp member firmly in position relative to the first clamp member.

To prepare the clamping device for use, the opposing face plates 8,15 are held parallel, for example by holding the plates against opposite sides of a parallel sided block of wood, and the screws 22 and 19 are screwed in until the second clamp member is locked onto the first clamp member as described above. The locking nut 20 is then tightened, and the clamp is ready for use. The screw 22 is released, thereby rotating the face plate 15 slightly anti-clockwise. Because the pivot axis about which the plate is rotating is below the plane of the plate relative to the screw 22, rotation of the plate 15 anti-clockwise also moves the plate 15 translationally slightly away from the plate 8. With the screw 22 released, the edge 17 is clear of the adjacent surface of the base 4, and the second clamp member 3 is free to slide along the base 4. In this configuration, the plates 8,15 diverge slightly, by perhaps 1° away from the base 4.

To position the clamp on a parallel sided support, the face plate 8 is placed firmly against one surface of the support, and the second clamp member is slid along the base to bring the face plate 15 into contact with the opposite surface of the support. Because the plates diverge slightly, if the plate 8 is in full face contact with the support, the plate 15 will only engage the support at some point near edge 17. With the plates 8 and 15 held lightly against opposite sides of the support, the screw 22 is tightened by hand rotating the plate 15 into a position parallel to the plate 8, and at the same time moving the plate 15 slightly in translation towards the plate 8. At the instant when the two plates become parallel, the edge 17 engages the adjacent surface of the base 4 preventing further rotation, and locking the second clamp member 3 in position as described above. Both plates 8 and 15 are now in full face contact with the support, the support being firmly gripped between the plates and the clamp members locked rigidly to each other.

The clamp is released by releasing screw 22 and sliding the second clamp member 3 away from the support.

Because the plates 8 and 15 are always parallel when the clamp is locked in position, regardless of the thickness of the support, the above described clamp can be positioned on a support of any thickness with both plates 8 and 15 in substantially full face contact with opposite surfaces of the support. Accordingly, the clamp will lock rigidly on to a support without rocking movement regardless of the thickness of the support. The fact that the clamping device described above will grip without rocking, any parallel sided support renders it particularly satisfactorily for supporting optical equipment, for example, a microfilm projector. To this end, an arm 23 may be telescopically mounted within the base 4 and locked in position by a screw 24. The projector can then be mounted on a bracket 25 to project downwardly on to the upper surface of the support.

The powerful and rigid clamping action provided by the above described clamping device renders it suitable both for clamping to a support in order to provide a mounting for ancillary equipment, e.g. a projector, or as a clamp per se for use in, for example, holding two workpieces together. If the device is to be used as a clamp per se, the angle $\theta$ is adventageously 90° so that plates 8 and 15 extend perpendicular to the longitudinal axis of the base 4.

What is claimed is:

1. A clamping device, comprising (a) a first clamp member (2) including (1) an elongate base (4) having smooth parallel sides; and (2) a first clamp arm (5) extending laterally outwardly from the base;

(b) a second clamp member (3) mounted for sliding movement along said base, said second clamp member including (1) a second clamp arm (16) extending laterally outwardly from said base opposite and generally parallel with said first clamp arm; and (2) pivot means (19) on said second clamp member for engaging the side surface of said base which is remote from said first and second clamp arms, thereby to define a pivot axis about which said second clamp arm is pivotable relative to said base;

(c) force applying means arranged on said second clamp member for engaging said first clamp member at a position spaced from said pivot axis, thereby to pivot said second clamp member about said pivot axis in a first direction causing displacement of said second clamp arm toward said first clamp arm; and (d) stop means (17) arranged on said second clamp member for engagement with said base member to limit rotation of said second clamp member in said first direction, whereby upon displacement of said second clamp member to any desired position relative to said base member, said force applying means may be operated to pivot said second clamp member in said first direction about said pivot axis and thereby displace said stop means toward locking engagement with said base member.

2. A clamping device according to claim 1 wherein the pivot means is adjustable relative to the second clamp member to adjust the angle defined between the clamp arms when the clamp members are locked together.

3. A clamping device according to claim 1 wherein the pivot means engages one side of the base, and the force applying means is a manually rotatable screw, threaded into the second clamp member to engage the same side of the base as the pivot means.

4. A clamping device according to claim 1 wherein the second clamp arm includes a face plate which faces the first clamp arm, the said stop being formed by the edge of the face plate adjacent the base.

* * * * *